US011401828B2

(12) United States Patent
Tomita et al.

(10) Patent No.: US 11,401,828 B2
(45) Date of Patent: Aug. 2, 2022

(54) ASYMMETRIC TURBOMACHINERY HOUSING FOR THERMAL EXPANSION

(71) Applicant: MITSUBISHI HEAVY INDUSTRIES ENGINE & TURBOCHARGER, LTD., Sagamihara (JP)

(72) Inventors: Isao Tomita, Tokyo (JP); Reiko Takashima, Tokyo (JP); Yutaka Fujita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 17/044,743

(22) PCT Filed: Dec. 21, 2018

(86) PCT No.: PCT/JP2018/047218
§ 371 (c)(1),
(2) Date: Oct. 1, 2020

(87) PCT Pub. No.: WO2020/129234
PCT Pub. Date: Jun. 25, 2020

(65) Prior Publication Data

US 2021/0017875 A1 Jan. 21, 2021

(51) Int. Cl.
*F01D 11/08* (2006.01)
*F01D 25/24* (2006.01)
(Continued)

(52) U.S. Cl.
CPC ..... *F01D 11/08* (2013.01); *F01D 25/24* (2013.01); *F01D 9/026* (2013.01); *F02B 39/00* (2013.01);
(Continued)

(58) Field of Classification Search
CPC ..... F01D 11/08; F01D 25/24; F01D 9/026; F02B 39/00; F04D 29/284; F04D 29/624;
(Continued)

(56) References Cited

U.S. PATENT DOCUMENTS

2005/0129976 A1 6/2005 Turnquist et al.
2016/0108921 A1 4/2016 Ishikawa
(Continued)

FOREIGN PATENT DOCUMENTS

EP 1541807 A2 6/2005
JP 62-126225 A 6/1987
(Continued)

OTHER PUBLICATIONS

European Office Action for European Application No. 18943371.7, dated Jul. 12, 2021.
(Continued)

*Primary Examiner* — J. Todd Newton
(74) *Attorney, Agent, or Firm* — Birch, Stewart, Kolasch & Birch, LLP

(57) ABSTRACT

A turbomachinery according to an embodiment includes an impeller including at least one blade, and a casing for housing the impeller rotatably. A size of a gap between a tip of the blade and an inner surface of the casing during a stop of the impeller is formed non-uniformly over a circumferential direction of the impeller.

11 Claims, 15 Drawing Sheets

(51) Int. Cl.

| | |
|---|---|
| *F01D 9/02* | (2006.01) |
| *F02B 39/00* | (2006.01) |
| *F04D 29/28* | (2006.01) |

(52) U.S. Cl.
CPC ..... *F04D 29/284* (2013.01); *F05D 2220/40* (2013.01)

(58) Field of Classification Search
CPC ... F04D 29/622; F04D 25/024; F05D 2220/40
USPC ..... 415/204
See application file for complete search history.

(56) References Cited

U.S. PATENT DOCUMENTS

| | | | |
|---|---|---|---|
| 2016/0319683 | A1 | 11/2016 | Yokoyama et al. |
| 2017/0276233 | A1 | 9/2017 | Nishioka et al. |

FOREIGN PATENT DOCUMENTS

| | | | |
|---|---|---|---|
| JP | 4-103293 | U | 9/1992 |
| JP | 2005-171999 | A | 6/2005 |
| JP | 2008-31892 | A | 2/2008 |
| JP | 2010-249070 | A | 11/2010 |
| JP | 5263562 | B2 | 8/2013 |
| JP | 2015-124743 | A | 7/2015 |
| JP | 2016-75194 | A | 5/2016 |
| JP | 2018-178725 | A | 11/2018 |
| WO | WO 2015/064272 | A1 | 5/2015 |
| WO | WO 2016/098230 | A1 | 6/2016 |

OTHER PUBLICATIONS

Extended European Search Report for European Application No. 18943371.7, dated Jan. 15, 2021.
International Preliminary Report on Patentability and Written Opinion of the International Searching Authority for International Application No. PCT/JP2018/047218, dated Jul. 1, 2021, with English translation of the Written Opinion.
International Search Report for International Application No. PCT/JP2018/047218, dated Jan. 29, 2019.

D-D

ASYMMETRIC TURBOMACHINERY HOUSING FOR THERMAL EXPANSION

TECHNICAL FIELD

The present disclosure relates to a turbomachinery.

BACKGROUND

A turbomachinery used for an industrial compressor, turbocharger, or the like is configured such that an impeller including a plurality of blades (rotor blades) is rotated to compress a fluid or to absorb power from the fluid.

As an example of the turbomachinery, a turbocharger can be given, for example.

The turbocharger includes a rotational shaft, a turbine wheel disposed on one end side of the rotational shaft, and a compressor wheel disposed on the other end side of the rotational shaft. Then, the rotational shaft rotates at a high speed in response to exhaust energy of an exhaust gas being applied to the turbine wheel, thereby configuring the compressor wheel disposed on the other end side of the rotational shaft to compress intake air (see Patent Document 1).

CITATION LIST

Patent Literature

Patent Document 1: WO2016/098230A

SUMMARY

Technical Problem

In a turbomachinery, a gap exists between the tip of a rotor blade and the inner surface of a casing. A leakage flow occurs from the gap, influencing a flow field and performance of the turbomachinery. Thus, it is desirable to narrow the above-described gap as much as possible. However, it is necessary to avoid contact of the rotor blade with the casing, even if deformation or the like of the rotor blade and the casing is caused by operating the turbomachinery.

Thus, it is necessary to consider the above-described deformation or the like on designing an impeller and the casing.

In view of the above, an object of at least one embodiment of the present invention is to appropriately form the gap between the tip of the rotor blade and the inner surface of the casing during the operation of the turbomachinery.

Solution to Problem (1) A turbomachinery according to at least one embodiment of the present invention includes an impeller including at least one blade, and a casing for housing the impeller rotatably. A size of a gap between a tip of the blade and an inner surface of the casing during a stop of the impeller is formed non-uniformly over a circumferential direction of the impeller.

With the above configuration (1), since the size of the above-described gap during the stop of the impeller is formed non-uniformly on purpose over the circumferential direction of the impeller, a change in the above-described gap due to deformation or the like of the impeller and the casing during a rotation of the impeller, that is, during an operation of the turbomachinery is offset, making it possible to get close to a state where the above-described gap during the operation is uniform over the circumferential direction. That is, regarding a portion at a risk of contact during the operation of the turbomachinery, the above-described gap during the stop is made larger than the above-described gap during the stop at another circumferential position, making it possible to offset the change in the above-described gap during the operation. Thus, it is possible to narrow the above-described gap during the operation and to suppress an efficiency decrease in the turbomachinery.

(2) In some embodiments, in the above configuration (1), a difference between a maximum value and a minimum value of the gap during the stop of the impeller is not less than 10% of an average value of the gap in the circumferential direction.

With the above configuration (2), since the difference between the maximum value and the minimum value of the above-described gap during the stop of the impeller is not less than 10% of the average value of the above-described gap in the circumferential direction, it is possible to further get close to the state where the above-described gap during the operation of the turbomachinery is uniform over the circumferential direction.

(3) In some embodiments, in the above configuration (1) or (2), the casing has an inner circumferential edge formed into an elliptical shape.

For example, the inner circumferential edge of the casing may be deformed so as to change from a circular shape to the elliptical shape, during the operation of the turbomachinery. In this case, the shape of the inner circumferential edge of the casing during the stop of the turbomachinery is preferably set to the elliptical shape in advance so as to be closer to the circular shape when the shape is changed as described above.

In this regard, with the above configuration (3), since the casing has the inner circumferential edge formed into the elliptical shape, it is possible to get close to the state where the above-described gap during the operation of the turbomachinery is uniform over the circumferential direction.

(4) In some embodiments, in any one of the above configurations (1) to (3), during the stop of the impeller, a center axis of the casing is parallel to a rotational axis of the impeller and is displaced from the rotational axis of the impeller to a radial direction.

For example, during the operation of the turbomachinery, the center axis of the casing and the rotational axis of the impeller may be displaced from each other. In this case, the center axis and the rotational axis during the stop of the turbomachinery is displaced from each other in advance in consideration of the above-described displacement during the operation of the turbomachinery, making it possible to reduce the displacement between the center axis and the rotational axis during the operation of the turbomachinery.

In this regard, with the above configuration (4), during the stop of the impeller, the center axis of the casing is parallel to the rotational axis of the impeller and is displaced from the rotational axis of the impeller to the radial direction. Thus, it is possible to reduce the displacement between the center axis and the rotational axis during the operation of the turbomachinery.

(5) In some embodiments, in any one of the above configurations (1) to (3), during the stop of the impeller, a center axis of the casing is not parallel to a rotational axis of the impeller.

For example, during the operation of the turbomachinery, the center axis of the casing and the rotational axis of the impeller may be displaced from each other and may no longer be parallel to each other. In this case, the center axis and the rotational axis during the stop of the turbomachinery is set non-parallel to each other in advance in consideration of the above-described displacement during the operation of the turbomachinery, making it possible to get close to a state where the center axis and the rotational axis are parallel to each other during the operation of the turbomachinery.

In this regard, with the above configuration (5), during the stop of the impeller, the center axis of the casing is not parallel to the rotational axis of the impeller. Thus, it is possible to get close to the state where the center axis and the rotational axis are parallel to each other during the operation of the turbomachinery.

(6) In some embodiments, in any one of the above configurations (1) to (5), the impeller is a radial flow impeller, and the casing is rotationally asymmetric about a center axis of the casing.

If the casing is rotationally asymmetric about the center axis of the casing, deformation due to thermal expansion is also represented rotationally asymmetrically about the center axis. Thus, in the turbomachinery including the casing which is rotationally asymmetric about the center axis of the casing, if the size of the above-described gap during the stop of the impeller is formed uniformly over the circumferential direction of the impeller, the size of the above-described gap may be non-uniform over the circumferential direction of the impeller during the operation of the impeller.

In this regard, with the above configuration (6), having the configuration according to any one of the above configurations (1) to (5), it is possible to get close to the state where the above-described gap during the operation is uniform over the circumferential direction.

(7) In some embodiments, in the above configuration (6), the casing includes a scroll part internally including a scroll flow passage where a fluid flows in the circumferential direction on a radially outer side of the impeller, and a tongue part for separating the scroll flow passage from a flow passage on a radially outer side of the scroll flow passage, and regarding the gap during the stop of the impeller, the gap in the tongue part is larger than an average value of the gap in the circumferential direction.

As a result of intensive researches by the present inventors, it was found that in the case in which the casing includes the scroll part, the above-described gap during the rotation of the impeller tends to be small compared to during the stop in a region where the flow-passage cross-sectional area of the scroll flow passage in the cross-section orthogonal to the extending direction of the scroll flow passage is relatively large, and the above-described gap during the rotation of the impeller tends to be large compared to during the stop in a region where the flow-passage cross-sectional area is relatively small.

Therefore, at a position, where the flow-passage cross-sectional area is the largest, of the position along the extending direction of the scroll flow passage, a decrement of the above-described gap during the operation relative to the above-described gap during the stop is the largest.

Moreover, in the case in which the casing includes the scroll part, the flow-passage cross-sectional area is the largest in the vicinity of the above-described tongue part. Therefore, in the case in which the casing includes the scroll part, the decrement of the above-described gap during the operation relative to the above-described gap during the stop is the largest in the vicinity of the above-described tongue part.

In this regard, with the above configuration (7), regarding the above-described gap during the stop of the impeller, the above-described gap in the tongue part is larger than the average value of the above-described gap in the circumferential direction. Therefore, with the above configuration (7), it is possible to get close to the state where the above-described gap during the operation is uniform over the circumferential direction.

(8) In some embodiments, in the above configuration (7), provided that an angular position of the tongue part is at 0 degrees in an angular range in the circumferential direction, and a direction, of an extending direction of the scroll flow passage, in which a flow-passage cross-sectional area of the scroll flow passage in a cross-section orthogonal to the extending direction gradually increases with distance from the tongue part along the extending direction, is a positive direction, the gap during the stop of the impeller has a maximum value during the stop of the impeller within an angular range of not less than −90 degrees and not more than 0 degrees.

In the case in which the casing includes the scroll part, the flow-passage cross-sectional area of the scroll flow passage is the largest within the above-described angular range of not less than −90 degrees and not more than 0 degrees, in general.

Moreover, as described above, at the position, where the flow-passage cross-sectional area is the largest, of the position along the extending direction of the scroll flow passage, the decrement of the above-described gap during the operation relative to the above-described gap during the stop is the largest.

In this regard, with the above configuration (8), the above-described gap during the stop of the impeller has the maximum value during the stop of the impeller within the angular range of not less than −90 degrees and not more than 0 degrees. Therefore, with the above configuration (8), it is possible to get close to the state where the above-described gap during the operation is uniform over the circumferential direction.

(9) In some embodiments, in any one of the above configurations (1) to (8), the size of the gap during the stop of the impeller is formed non-uniformly over the circumferential direction of the impeller, in at least one of at least a part of a region between a leading edge of the blade and a position away by a distance of 20% of a total length of the tip from the leading edge toward a trailing edge of the blade, or at least a part of a region between the trailing edge and a position away by a distance of 20% of the total length from the trailing edge toward the leading edge.

In the turbomachinery, it is possible to effectively improve efficiency of the turbomachinery by narrowing the above-described gap in the vicinity of the leading edge and in the vicinity of the trailing edge.

In this regard, with the above configuration (9), in at least one of the vicinity of the leading edge or the vicinity of the trailing edge, the above-described gap is formed non-uniformly over the circumferential direction. Therefore, in at least one of the vicinity of the leading edge or the vicinity of the trailing edge, it is possible to get close to the state where the above-described gap during the operation is uniform over the circumferential direction. Thus, it is possible to effectively suppress the efficiency decrease in the turbomachinery.

(10) In some embodiments, in any one of the above configurations (1) to (5), the impeller is an axial flow impeller with a rotational axis thereof extending in a horizontal direction, and the casing is supported by a first support table and a second support table disposed away from the first support table in a direction along the rotational axis of the impeller.

In the turbomachinery including the axial flow impeller, in a case in which the size of the casing along the axial direction is relatively large, such as a case in which a plurality of stages of blades are disposed along the axial direction or a case in which the turbomachinery is relatively large, the casing may be supported by the first support table and the second support table disposed away from the first support table in the direction along the rotational axis of the impeller.

In such a turbomachinery, the casing easily bends downward between the first support table and the second support table, under its own weight. Thus, during the operation of the turbomachinery, it is considered that the casing bends more easily due to the influence of thermal expansion or the like.

In this regard, with the above configuration (10), having the configuration according to any one of the above configurations (1) to (5), in consideration of an influence on the above-described gap given by the above-described bend of the casing, the above-described gap during the stop of the impeller is formed non-uniformly over the circumferential direction of the impeller, making it possible to get close to the state where the above-described gap during the operation is uniform over the circumferential direction. Thus, it is possible to suppress the efficiency decrease in the turbomachinery.

(11) In some embodiments, in the above configuration (10), the gap during the stop of the impeller is larger than an average value of the gap in the circumferential direction, at an intermediate position between the first support table and the second support table and at a position, of a position along the circumferential direction, in a vertically upward direction of the impeller.

In the turbomachinery where the casing is supported by the above-described first support table and the above-described second support table, the casing easily bends downward between the first support table and the second support table, and it is considered that the casing bends more easily during the operation of the turbomachinery, as described above.

In this regard, setting the above-described gap as in the above configuration (11), it is possible to get close to the state where the above-described gap during the operation at the above-described intermediate position is uniform over the circumferential direction.

(12) In some embodiments, in the above configuration (10) or (11), the gap during the stop of the impeller is larger than an average value of the gap in the circumferential direction, at positions at both ends of the impeller along a direction of the rotational axis, and at a position, of a position along the circumferential direction, in a vertically downward direction of the impeller.

In the turbomachinery where the casing is supported by the above-described first support table and the above-described second support table, at the positions at both ends of the impeller along the direction of the rotational axis, the casing easily bends upward, contrary to the case of the intermediate position between the first support table and the second support table, and it is considered that the casing bends more easily during the operation of the turbomachinery.

In this regard, setting the above-described gap as in the above configuration (12), it is possible to get close to the state where the above-described gap during the operation at the positions of both ends of the impeller along the direction of the rotational axis is uniform over the circumferential direction.

(13) In some embodiments, in any one of the above configurations (1) to (12), the size of the gap in the circumferential direction varies more widely during the stop of the impeller than during a rotation of the impeller.

With the above configuration (13), the variation in the size of the gap in the circumferential direction is smaller during the rotation of the impeller than during the stop of the impeller. Thus, it is possible to reduce the variation by getting close to the state where the above-described gap during the rotation of the impeller, that is, during the operation of the turbomachinery is uniform over the circumferential direction.

Advantageous Effects

According to at least one embodiment of the present invention, it is possible to appropriately form a gap between the tip of a rotor blade and the inner surface of a casing during an operation of a turbomachinery.

DETAILED DESCRIPTION

Figure 1:
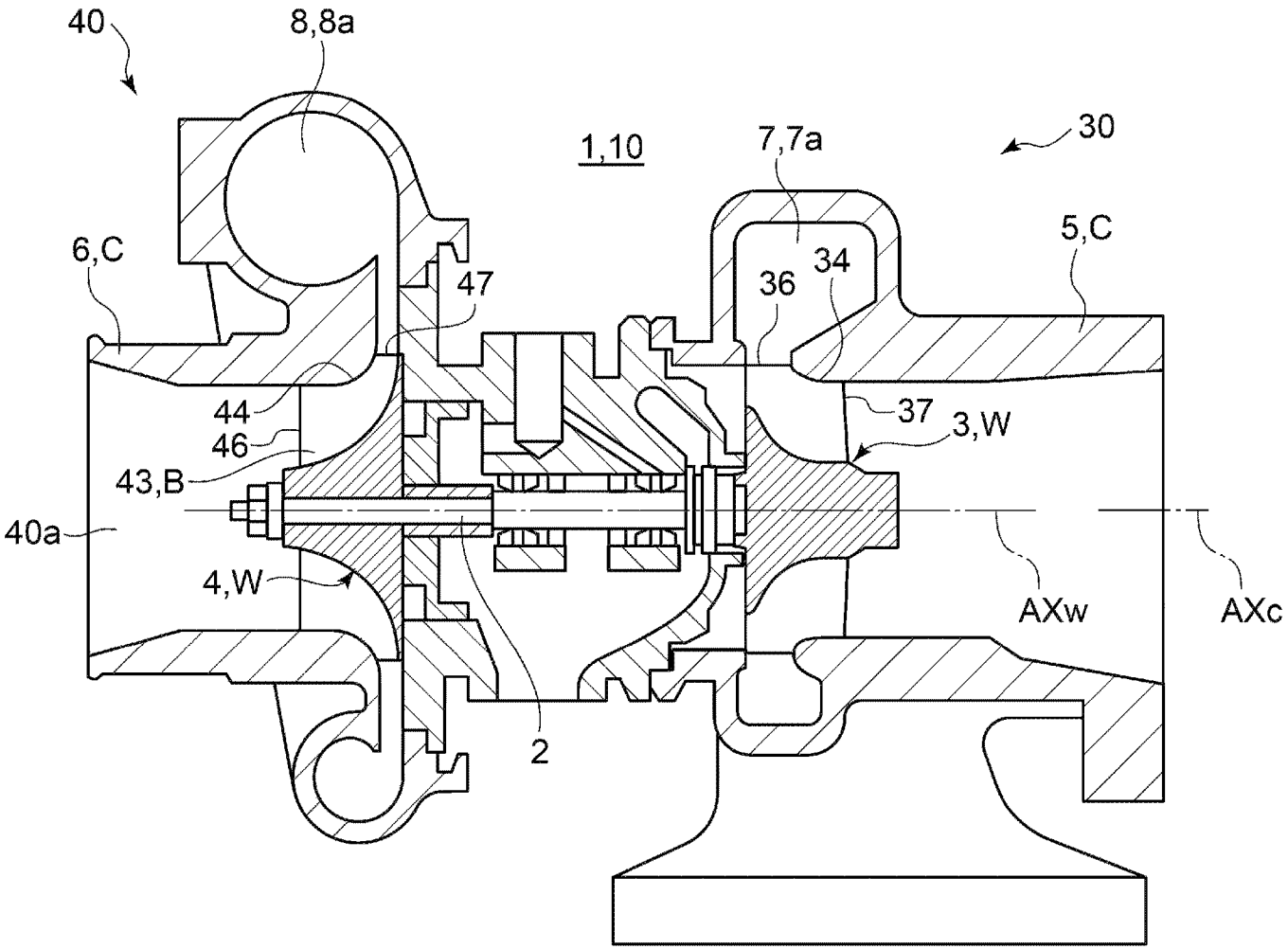
FIG. 1 is a cross-sectional view showing an example of a turbocharger according to some embodiments, as an example of a turbomachinery.

Some embodiments of the present invention will be described below with reference to the accompanying drawings. It is intended, however, that unless particularly identified, dimensions, materials, shapes, relative positions and the like of components described in the embodiments or shown in the drawings shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, the expressions "comprising", "including", "having", "containing", and "constituting" one constituent component are not exclusive expressions that exclude the presence of other constituent components.

FIG. 1 is a cross-sectional view showing an example of a turbocharger 1 according to some embodiments, as an example of a turbomachinery.

The turbocharger 1 according to some embodiments is an exhaust turbocharger for supercharging intake air of an engine mounted on a vehicle such as an automobile.

The turbocharger 1 includes a turbine wheel 3 and a compressor wheel 4 coupled to each other with a rotor shaft 2 as a rotational shaft, a casing (turbine housing) 5 for housing the turbine wheel 3 rotatably, and a casing (compressor housing) 6 for housing the compressor wheel 4 rotatably. Moreover, the turbine housing 5 includes a scroll part 7 internally having a scroll flow passage 7*a*. The compressor housing 6 includes a scroll part 8 internally having a scroll flow passage 8*a*.

A turbine 30 according to some embodiments includes the turbine wheel 3 and the casing 5. A compressor 40 according to some embodiments includes the compressor wheel 4 and the casing 6.

Figure 2:
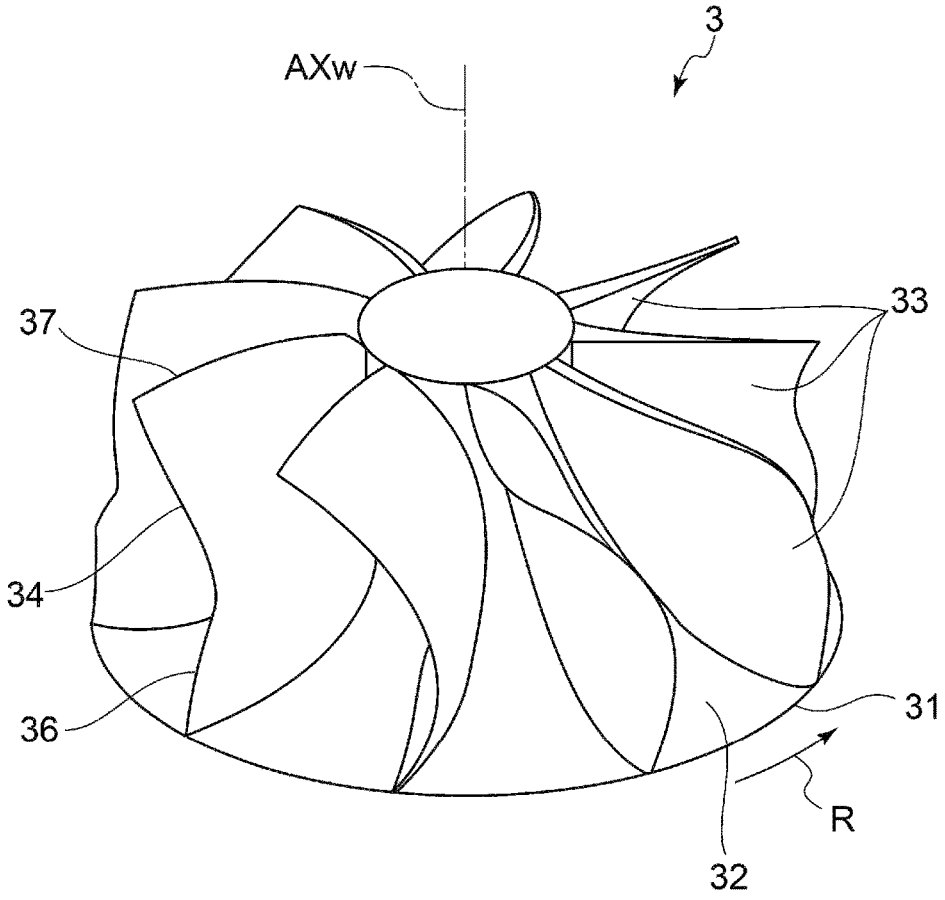
FIG. 2 is a perspective view showing the appearance of a turbine wheel according to some embodiments.

FIG. 2 is a perspective view showing the appearance of the turbine wheel 3 according to some embodiments.

The turbine wheel 3 according to some embodiments is an impeller coupled to the rotor shaft (rotational shaft) 2 and rotated about a rotational axis AXw. The turbine wheel 3 according to some embodiments includes a hub 31 having a hub surface 32 oblique to the rotational axis AXw and a plurality of blades (rotor blades) 33 disposed on the hub surface 32, in a cross-section along the rotational axis AXw. The turbine wheel 3 shown in FIG. 1, 2 is a radial turbine, but may be a mixed flow turbine. In FIG. 2, an arrow R indicates a rotational direction of the turbine wheel 3. The plurality of blades 33 are disposed at intervals in the circumferential direction of the turbine wheel 3.

Although illustration by the perspective view is omitted, the compressor wheel 4 according to some embodiments also have the same configuration as the turbine wheel 3 according to some embodiments. That is, the compressor wheel 4 according to some embodiments is an impeller coupled to the rotor shaft (rotational shaft) 2 and rotated about the rotational axis AXw. The compressor wheel 4 according to some embodiments includes a hub 41 having a hub surface 42 oblique to the rotational axis AXw and a plurality of blades (rotor blades) 43 disposed on the hub surface 42, in the cross-section along the rotational axis AXw. The plurality of blades 43 are disposed at intervals in the circumferential direction of the compressor wheel 4.

In the turbocharger 1 thus configured, an exhaust gas serving as a working fluid flows from a leading edge 36 toward a trailing edge 37 of the turbine wheel 3. Consequently, the turbine wheel 3 is rotated, and the compressor wheel 4 of the compressor 40 coupled to the turbine wheel 3 via the rotor shaft 2 is also rotated. Consequently, intake air flowing in from an inlet part 40*a* of the compressor 40 is compressed by the compressor wheel 4 in the process of flowing from a leading edge 46 toward a trailing edge 47 of the compressor wheel 4.

In a description below, regarding contents about the turbomachinery which are common with the turbine 30 and the compressor 40, the respective constituent elements described above may be denoted as follows.

For example, in a case in which the turbine wheel 3 and the compressor wheel 4 need not particularly be distinguished from each other, the turbine wheel 3 or the compressor wheel 4 may be referred to as an impeller W.

Moreover, in a case in which the blades 33 of the turbine wheel 3 and the blades 43 of the compressor wheel 4 need not particularly be distinguished from each other, reference numerals for the blades may be changed to B to denote each of the blades as a blade B.

In a case in which the casing 5 of the turbine 30 and the casing 6 of the compressor 40 need not particularly be distinguished from each other, reference numerals for the casings may be changed to C to denote each of the casings as a casing C.

That is, a turbomachinery 10 according to some embodiments to be described below includes the impeller W having at least one blade B and the casing C for housing the impeller W rotatably.

Figure 3:
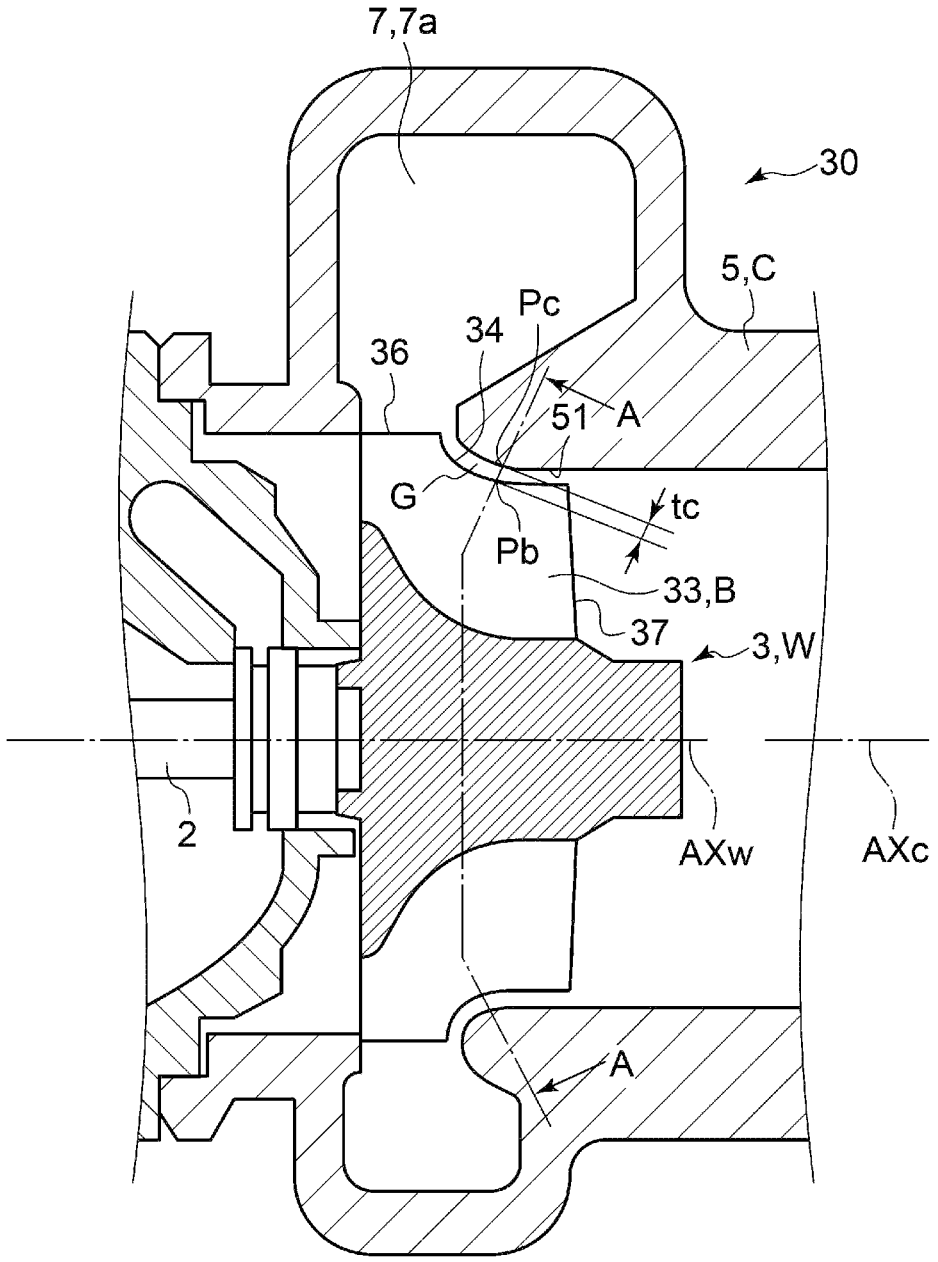
FIG. 3 is a view schematically showing the cross-section of a turbine according to some embodiments.

FIG. 3 is a view schematically showing the cross-section of the turbine 30 according to some embodiments.

In the description below, the structure of the turbomachinery 10 according to some embodiments will be described with reference to the structure of the turbine 30 according to some embodiments. However, contents of the description are also applicable to the compressor 40 according to some embodiments in the same manner, unless otherwise noted.

In the turbomachinery, for example, as in the turbine 30 shown in FIG. 3, a gap G exists between a tip 34 of the blade 33 and an inner surface 51 of the casing 5. A leakage flow occurs from the gap G, influencing a flow field and performance of the turbomachinery. Thus, in the turbomachinery, it is desirable to narrow the gap G as much as possible. However, it is necessary to avoid contact of the blade B with the casing C, even if deformation or the like of the blade B and casing C is caused by operating the turbomachinery.

Thus, it is necessary to consider the above-described deformation or the like on designing the impeller W and the casing C.

Thus, in the turbomachinery 10 according to some embodiments, with a configuration to be described below, a loss in the turbomachinery 10 is suppressed by forming the gap G with an appropriate size, while avoiding the contact of the blade B with the casing C.

In the description below, the gap G has a size tc as follows. That is, the size tc of the gap G is a distance between a point Pb and a point Pc closest to the point Pb on the inner surface 51 of the casing C. The point Pb is disposed at any position between the leading edge 36 and the trailing edge 37 along the tip 34 of the blade B.

In the following description, during a stop of the impeller W or during a stop of the turbomachinery 10 refers to during a cold stop of the impeller W or the turbomachinery 10, and includes a case in which at least a temperature of each part of the turbomachinery 10 is equal to a temperature around the turbomachinery 10. Moreover, in the following description, during a rotation of the impeller W or during an operation of the turbomachinery 10 refers to during a warm operation of the impeller W or the turbomachinery 10, and includes a case in which at least the temperature of each part of the turbomachinery 10 is equal to a temperature reached when the turbomachinery 10 operates normally.

Figure 4:
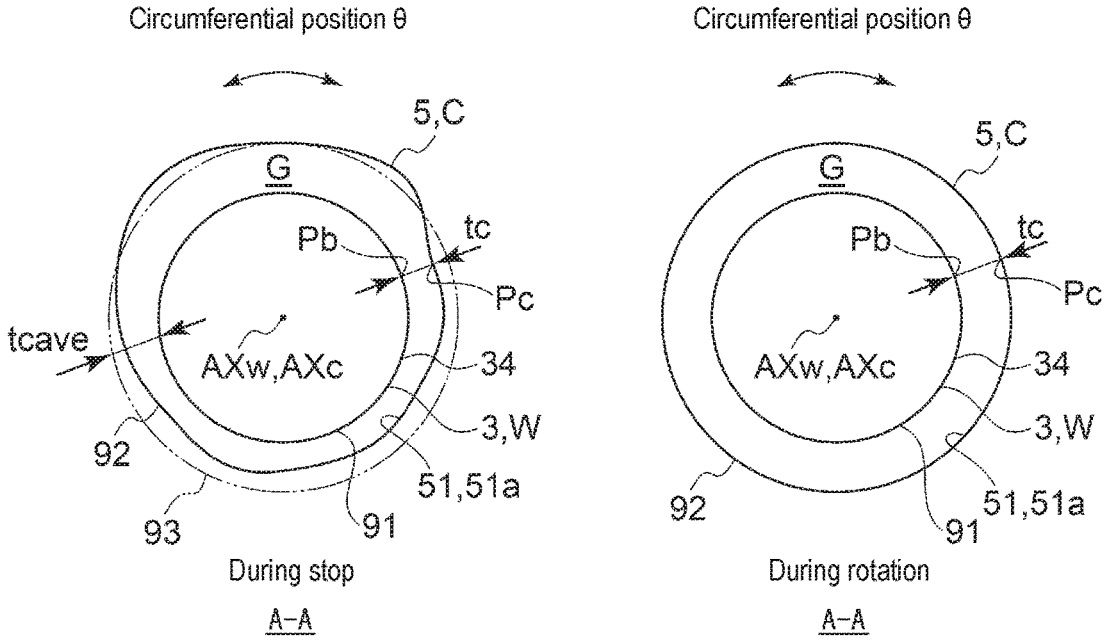
FIG. 4 are views schematically showing a gap during a stop and during a rotation of an impeller according to an embodiment, and each corresponding to an arrow view taken along line A-A in FIG. 3.

FIG. 4 are views schematically showing the gap G during the stop and during the rotation of the impeller W according to an embodiment, and each corresponding to an arrow view taken along line A-A of FIG. 3.

Figure 5:
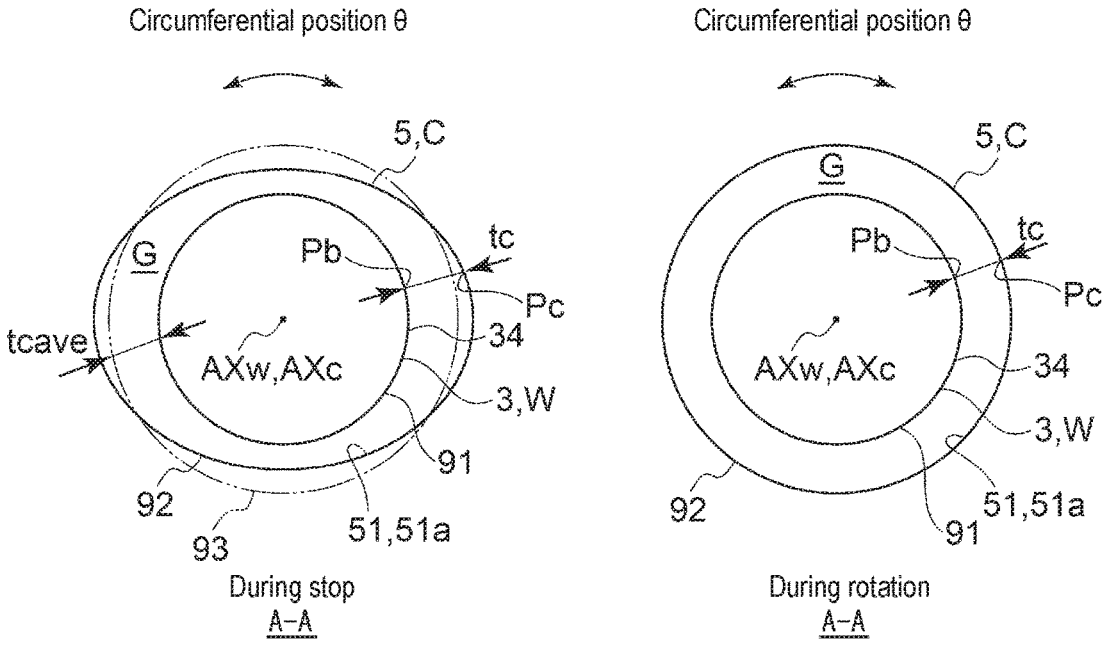
FIG. 5 are views schematically showing the gap during the stop and during the rotation of the impeller according to an embodiment, and each corresponding to an arrow view taken along line A-A in FIG. 3.

FIG. 5 are views schematically showing the gap G during the stop and during the rotation of the impeller W according to an embodiment, and each corresponding to an arrow view taken along line A-A of FIG. 3.

Figure 6:
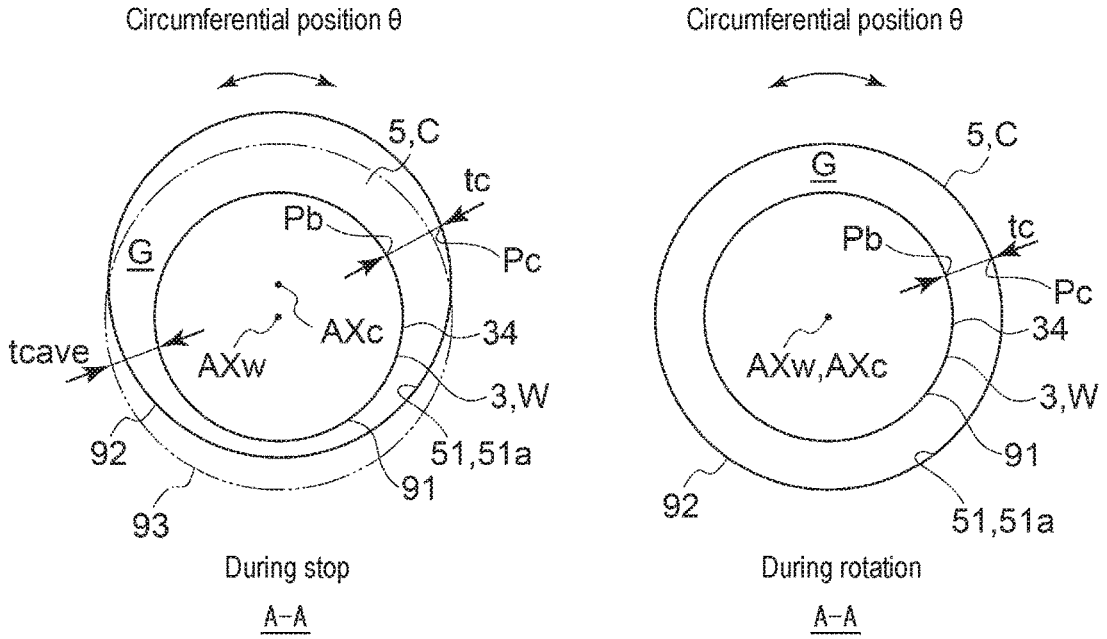
FIG. 6 are views schematically showing the gap during the stop and during the rotation of the impeller according to an embodiment, and each corresponding to an arrow view taken along line A-A in FIG. 3.

FIG. 6 are views schematically showing the gap G during the stop and during the rotation of the impeller W according to an embodiment, and each corresponding to an arrow view taken along line A-A of FIG. 3.

Figure 7:
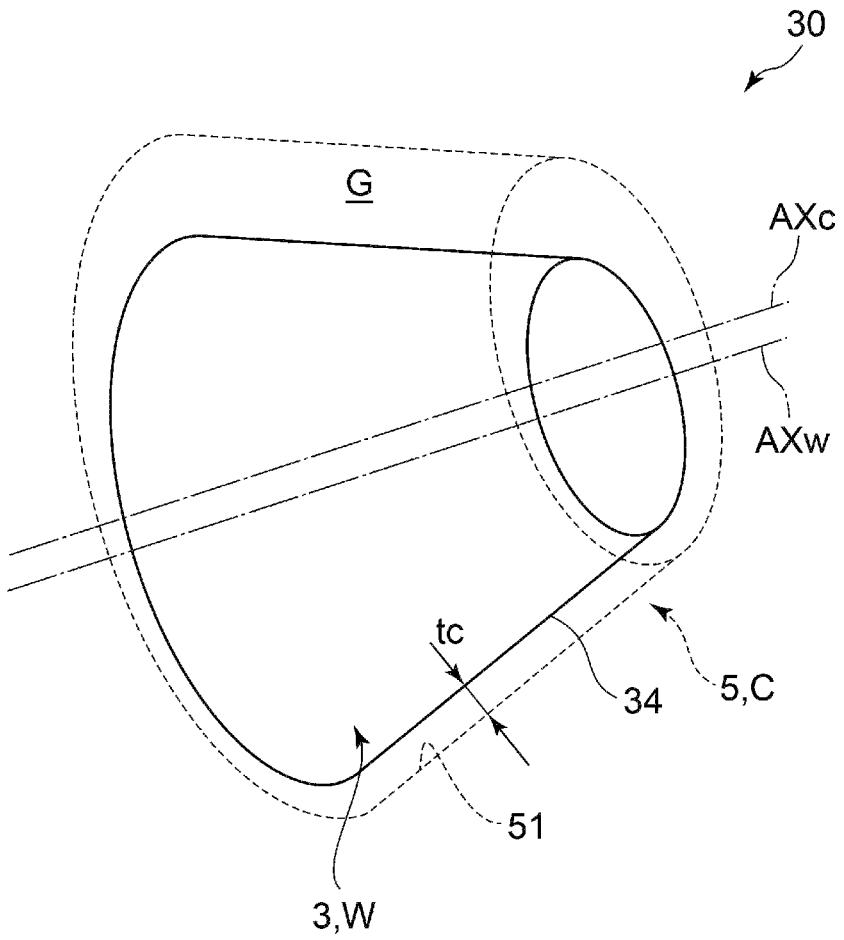
FIG. 7 is a view schematically showing the relationship between the impeller and a casing according to an embodiment.

FIG. 7 is a view schematically showing the relationship between the impeller W and the casing C according to an embodiment.

Figure 8:
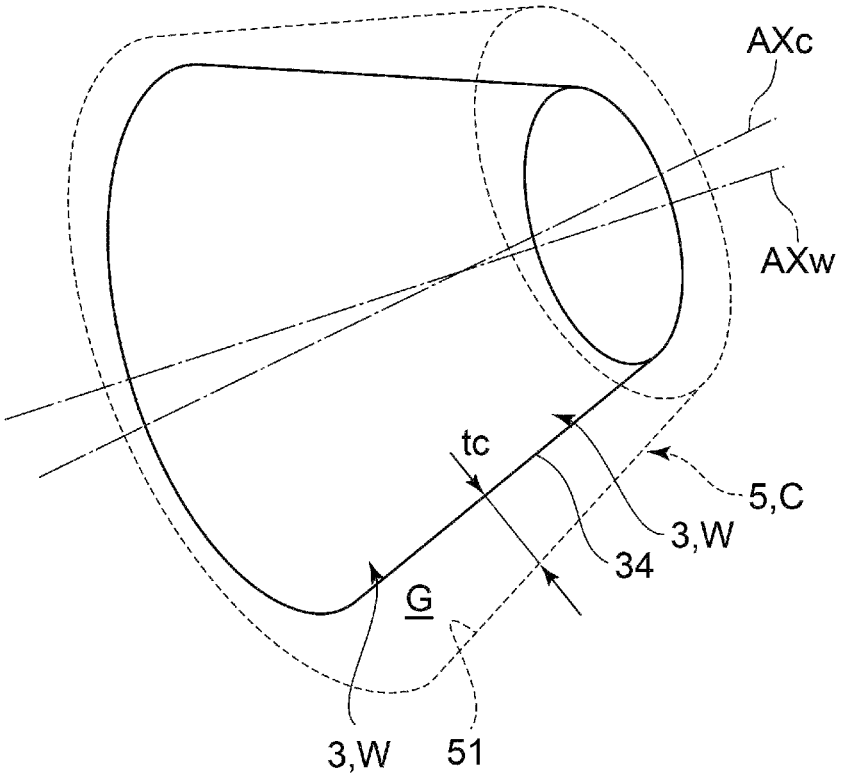
FIG. 8 is a view schematically showing the relationship between the impeller and the casing according to an embodiment.

FIG. 8 is a view schematically showing the relationship between the impeller W and the casing C according to an embodiment.

Figure 9:
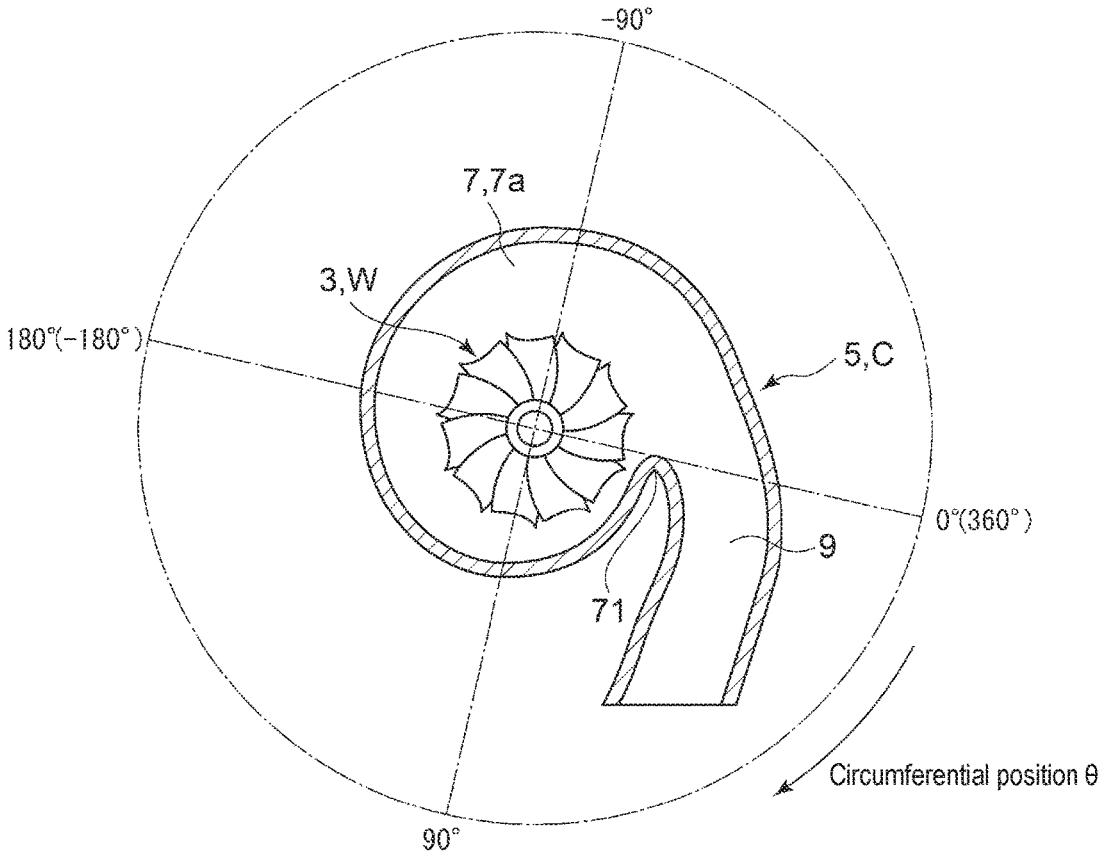
FIG. 9 is a view for describing a scroll part and is a cross-sectional view in a cross-section orthogonal to a rotational axis.

FIG. 9 is a view for describing the scroll part and is a cross-sectional view in a cross-section orthogonal to the rotational axis AXw.

Figure 10:
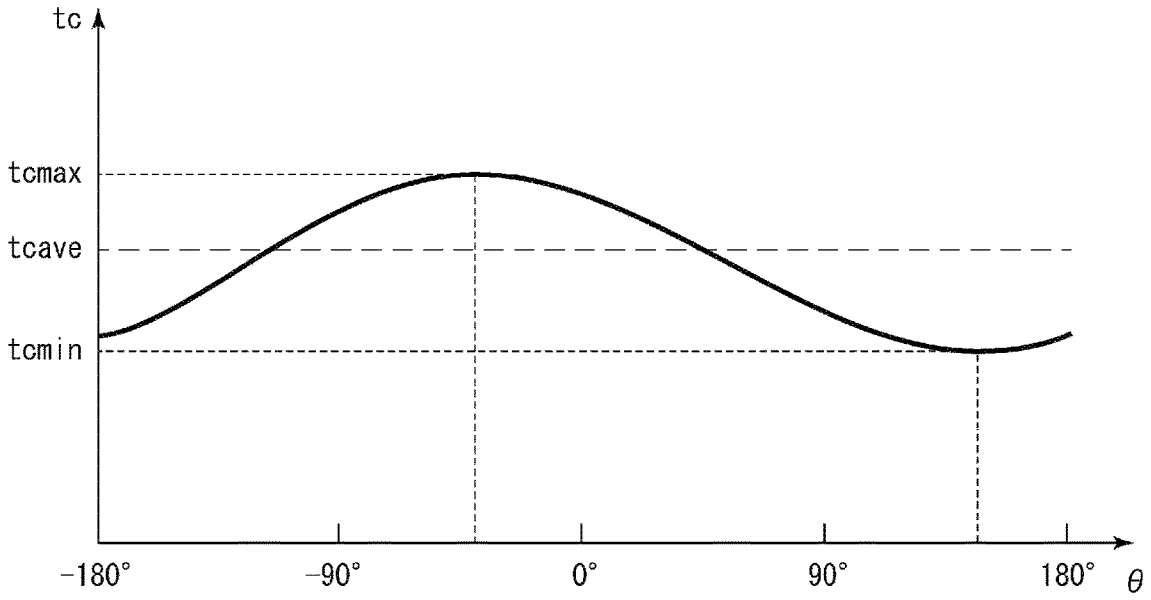
FIG. 10 is a graph representing the gap during the stop of the impeller according to an embodiment and is a graph with the abscissa indicating a circumferential position and the ordinate indicating the size of the gap.

FIG. 10 is a graph representing the gap G during the stop of the impeller W according to an embodiment and is a graph with the abscissa indicating a circumferential position θ and the ordinate indicating the size tc of the gap G.

Figure 11:
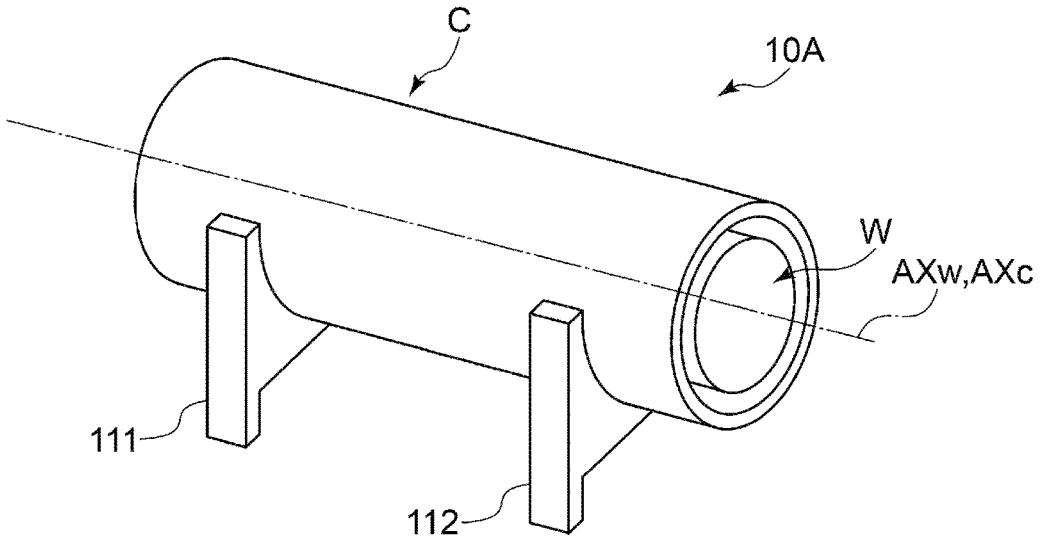
FIG. 11 is a schematic perspective view of an axial flow turbomachinery according to an embodiment.

FIG. 11 is a schematic perspective view of an axial flow turbomachinery 10A according to an embodiment.

Figure 12:
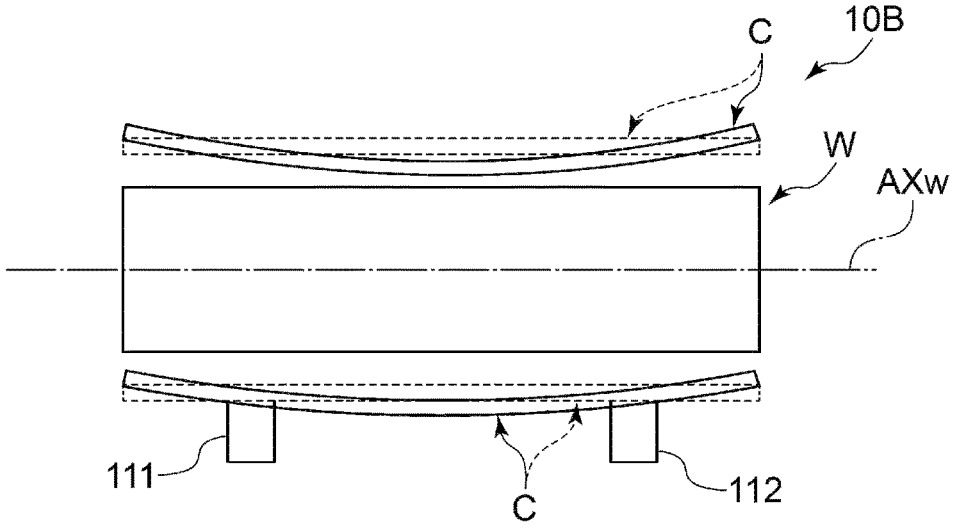
FIG. 12 is a schematic view for describing deformation of a casing of a conventional axial flow turbomachinery.

FIG. 12 is a schematic view for describing deformation of the casing C of a conventional axial flow turbomachinery 10B.

Figure 13:
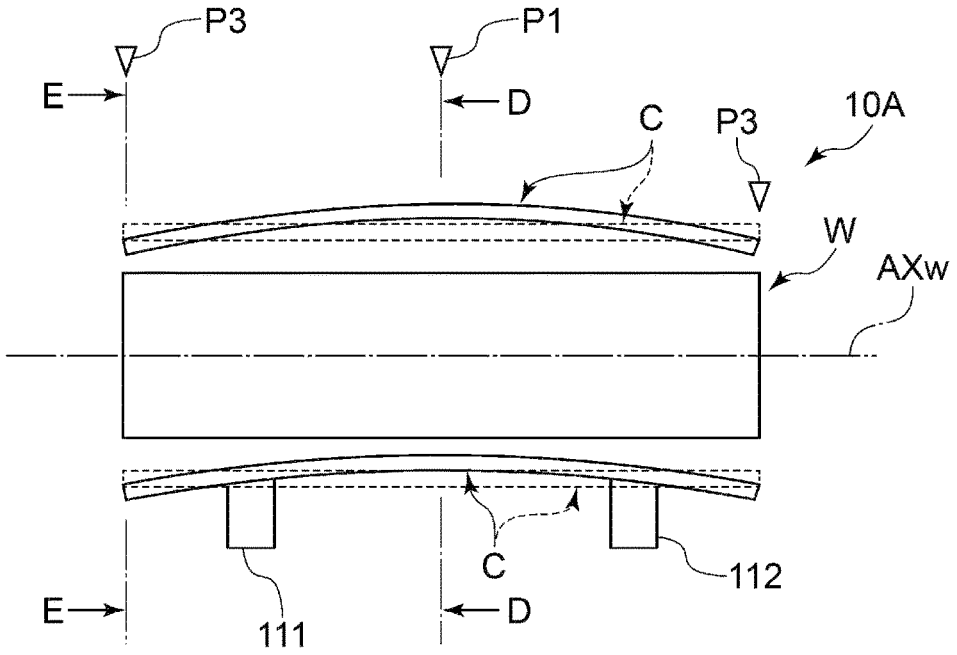
FIG. 13 is a schematic cross-sectional view of the axial flow turbomachinery according to an embodiment.

FIG. 13 is a schematic cross-sectional view of the axial flow turbomachinery 10A according to an embodiment.

Figure 14:
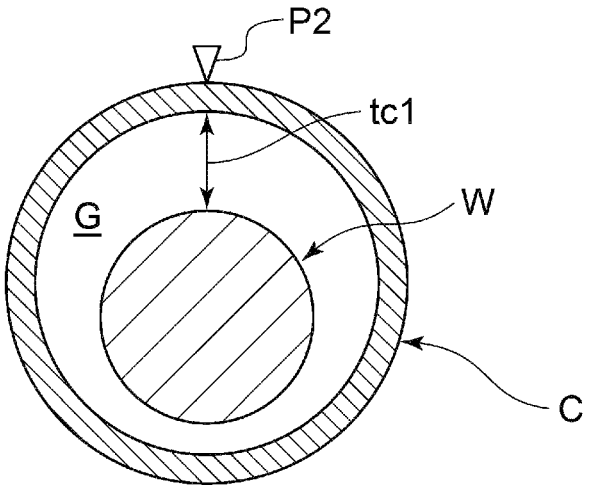
FIG. 14 is an arrow cross-sectional view taken along line D-D in FIG. 13.

FIG. 14 is an arrow cross-sectional view taken along line D-D in FIG. 13.

Figure 15:
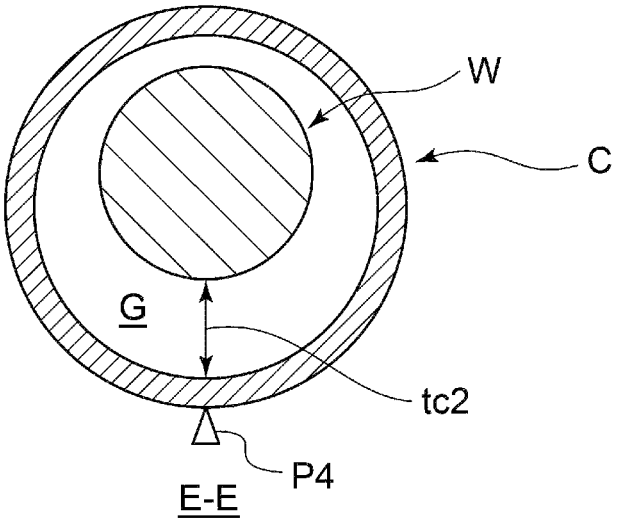
FIG. 15 is an arrow cross-sectional view taken along line E-E in FIG. 13.

FIG. 15 is an arrow cross-sectional view taken along line E-E in FIG. 13.

The point Pb shown in FIG. 3 draws a locus to be a circle centered at the rotational axis AXw by the rotation of the impeller W. Thus, in each of FIGS. 4 to 6, the point Pb is represented as a locus 91 when the impeller W is rotated. Moreover, if the circumferential position θ of the point Pb changes, the circumferential position θ of the point Pc also changes. Thus, in each of FIGS. 4 to 6, a position of the point Pc that can be taken in accordance with the change in the circumferential position θ of the point Pb is drawn by an annular line 92.

In each of FIGS. 4 to 6, a region between the locus 91 and the line 92 is the gap G, and the size tc of the gap G at any circumferential position θ is represented by a distance between the locus 91 and the line 92 at any circumferential position θ.

In each of FIGS. 4 to 6, a circle indicated by a long dashed double-dotted line 93 represents an average value tcave of the size of the gap Gin the circumferential direction.

The average value tcave of the gap G in the circumferential direction is, for example, an average value of the size tc of the gap G which differs depending on the position of the circumferential position θ.

In each of FIGS. 4 to 6, the size tc of the gap G is overdrawn.

FIG. 7, 8 is a view showing a state during the stop of the impeller W, and illustrates the impeller W and the casing C by simple cone shapes, respectively. In FIG. 7, a center axis AXc of the casing C is parallel to the rotational axis AXw of the impeller W and is displaced from the rotational axis AXw of the impeller W to the radial direction. In FIG. 8, the center axis AXc of the casing C is not parallel to the rotational axis AXw of the impeller W.

The axial flow turbomachinery 10A according to an embodiment shown in FIG. 11 includes the casing C and the impeller W. The axial flow turbomachinery 10A according to an embodiment shown in FIG. 11 is an axial flow impeller with the rotational axis AXw extending in the horizontal direction. In the axial flow turbomachinery 10A according to an embodiment shown in FIG. 11, the casing C is supported by a first support table 111 and a second support table 112 disposed away from the first support table in a direction along the rotational axis AXw of the impeller W.

For example, in some embodiments shown in FIGS. 3 to 8, the size tc of the gap G between the tip 34 of the blade B and the inner surface 51 of the casing C during the stop of the impeller W is formed non-uniformly over the circumferential direction of the impeller W.

In some embodiments shown in FIGS. 3 to 8, since the size tc of the gap G during the stop, that is, during the cold stop of the impeller W is formed non-uniformly on purpose over the circumferential direction of the impeller W, a change in the gap G due to the deformation or the like of the impeller W and the casing C during the rotation of the impeller W, that is, during the warm operation of the turbomachinery 10 is offset, making it possible to get close to a state where the gap G during the operation is uniform over the circumferential direction.

That is, regarding a portion at a risk of contact during the operation of the turbomachinery 10, the gap G during the stop is made larger than the gap G during the stop at another circumferential position, making it possible to offset the change in the gap G during the operation. Thus, it is possible to narrow the gap G during the operation and to suppress an efficiency decrease in the turbomachinery 10.

For example, in some embodiments shown in FIGS. 3 to 8, a variation in size of the gap G in the circumferential direction is larger during the stop of the impeller W than during the rotation of the impeller W.

In some embodiments shown in FIGS. 3 to 8, the variation in the size tc of the gap G in the circumferential direction is smaller during the rotation of the impeller W than during the stop of the impeller W. Thus, it is possible to reduce the variation by getting close to the state where the gap G during the rotation of the impeller W, that is, during the warm operation of the turbomachinery 10 is uniform over the circumferential direction.

The variation in the size tc of the gap G in the circumferential direction is, for example, a dispersion, a standard deviation, or the like of the size tc of the gap G which differs depending on the position of the circumferential position θ.

For example, in an embodiment shown in FIG. 5, an inner circumferential edge 51*a* of the casing C has an elliptical shape.

The inner circumferential edge 51*a* is the inner edge of the casing C, which appears in a cross-section where the casing C is squared with the rotational axis AXw, and is a crossing portion between the inner surface 51 and the cross-section.

For example, the inner circumferential edge 51*a* of the casing C may be deformed so as to change from a circular shape to the elliptical shape, during the operation of the turbomachinery 10. In this case, the shape of the inner circumferential edge 51*a* of the casing C during the stop of the turbomachinery 10 is preferably set to the elliptical shape in advance so as to be closer to the circular shape when the shape is changed as described above.

Thus, it is possible to get close to the state where the gap G during the operation of the turbomachinery 10 is uniform over the circumferential direction.

For example, in some embodiments show in FIGS. 6 and 7, during the stop of the impeller W, the center axis AXc of the casing C is parallel to the rotational axis AXw of the impeller W and is displaced from the rotational axis AXw of the impeller W to the radial direction of the impeller W.

For example, during the operation of the turbomachinery 10, the center axis AXc of the casing C and the rotational axis AXw of the impeller W may be displaced from each other. In this case, the center axis AXc and the rotational axis AXw during the stop of the turbomachinery 10 is displaced from each other in advance in consideration of the above-described displacement during the operation of the turbomachinery 10, making it possible to reduce the displacement between the center axis AXc and the rotational axis AXw during the operation of the turbomachinery 10.

In this regard, for example, according to some embodiments show in FIGS. 6 and 7, during the stop of the impeller W, the center axis AXc of the casing C is parallel to the rotational axis AXw of the impeller W and is displaced from the rotational axis AXw of the impeller W to the radial direction. Thus, it is possible to reduce the displacement between the center axis AXc and the rotational axis AXw during the operation of the turbomachinery 10.

For example, in an embodiment show in FIG. 8, during the stop of the impeller W, the center axis of the casing is not parallel to the rotational axis of the impeller.

For example, during the operation of the turbomachinery 10, the center axis AXc of the casing C and the rotational axis AXw of the impeller W may be displaced from each other and may no longer be parallel to each other. In this case, the center axis AXc and the rotational axis AXw during the stop of the turbomachinery 10 is set non-parallel to each other in advance in consideration of the above-described displacement during the operation of the turbomachinery 10, making it possible to get close to a state where the center axis AXc and the rotational axis AXw are parallel to each other during the operation of the turbomachinery 10.

In this regard, for example, according to an embodiment show in FIG. 8, during the stop of the impeller W, the center axis AXc of the casing C is not parallel to the rotational axis AXw of the impeller W. Thus, it is possible to get close to the state where the center axis AXc and the rotational axis AXw are parallel to each other during the operation of the turbomachinery 10.

In some embodiments described above and some embodiments to be described later, a difference between a maximum value tcmax and a minimum value tcmin of the gap G during the stop of the impeller W is preferably not less than 10% of the average value tcave in of the gap G in the circumferential direction.

Thus, it is possible to further get close to the state where the gap G during the operation of the turbomachinery 10 is uniform over the circumferential direction.

For example, as shown in FIGS. 1, 3, and 9, in some embodiments, the impeller W is the radial flow impeller W. Then, for example, as shown in FIGS. 1, 3, and 9, in some embodiments, the casing C is rotationally asymmetric about the center axis AXc of the casing C.

For example, as shown in FIGS. 1, 3, and 9, if the casing C is rotationally asymmetric about the center axis AXc of the casing C as in the case in which the casing C includes the scroll parts 7 and 8, deformation due to thermal expansion is also represented rotationally asymmetrically about the center axis AXc. Thus, in the turbomachinery 10 including the casing C which is rotationally asymmetric about the center axis AXc of the casing C, if the size of the gap G during the stop of the impeller W is formed uniformly over the circumferential direction of the impeller W, the size of the gap G may be non-uniform over the circumferential direction of the impeller W during the operation of the impeller W.

In this regard, according to some embodiments described above, since the size tc of the gap G between the tip 34 of the blade B and the inner surface 51 of the casing C during the stop of the impeller W is formed non-uniformly over the circumferential direction of the impeller W as described above, it is possible to get close to the state where the gap G during the operation is uniform over the circumferential direction.

As the case in which the casing C is rotationally asymmetric about the center axis AXc, for example, the following case is also considered, in addition to the case in which the casing C includes the scroll parts 7 and 8 as described above.

For example, a case is considered in which an addition is added such that the casing C is rotationally asymmetric about the center axis AXc, such as a structure for supporting the casing C is attached to the casing C, and the shape of the casing C including the addition is rotationally asymmetric about the center axis AXc.

Moreover, for example, a case is considered in which thermal expansion of the casing C is restricted by the structure.

For example, as shown in FIGS. 1, 3, and 9, in some embodiments, the casing C includes the scroll parts 7 and 8 internally including the scroll flow passages 7*a* and 8*a*, respectively, where the fluid flows in the circumferential direction on the radially outer side of the impeller W. For example, as shown in FIG. 9, in some embodiments, the casing C includes a tongue part 71 for separating the scroll flow passage 7*a* from a flow passage 9 on the radially outer side of the scroll flow passage 7*a*. For example, as shown in FIG. 10, in some embodiments, regarding the gap G during the stop of the impeller W, the gap G in the tongue part 71 is larger than the average value of the gap Gin the circumferential direction.

In FIG. 10, of an angular range in the circumferential direction, an angular position of the tongue part 71 is at 0 degrees as shown in FIG.9, and of the extending direction of the scroll flow passage 7*a*, a direction, in which a flow-passage cross-sectional area of the scroll flow passage 7*a* in the cross-section orthogonal to the extending direction gradually increases with distance from the tongue part 71 along the extending direction, is a positive direction.

As a result of intensive researches by the present inventors, it was found that in the case in which the casing C includes the scroll part 7, 8, the gap G during the rotation of the impeller W tends to be small compared to during the stop in a region where the flow-passage cross-sectional area of the scroll flow passage 7*a*, 8*a* in the cross-section orthogonal to the extending direction of the scroll flow passage is relatively large, and the gap G during the rotation of the impeller W tends to be large compared to during the stop in a region where the flow-passage cross-sectional area is relatively small.

Therefore, at a position, where the flow-passage cross-sectional area is the largest, of the position along the extending direction of the scroll flow passage 7*a*, 8*a*, a decrement of the gap G during the operation relative to the gap G during the stop is the largest.

Moreover, in the case in which the casing C includes the scroll part 7, 8, the flow-passage cross-sectional area is the largest in the vicinity of a tongue part (tongue part 71). Therefore, in the case in which the casing C includes the scroll part 7, 8, the decrement of the gap G during the operation relative to the gap G during the stop is the largest in the vicinity of the above-described tongue part (tongue part 71).

In this regard, in some embodiments, as shown in FIG. 10, regarding the gap G during the stop of the impeller W, the size tc of the gap Gin the tongue part 71 is larger than the average value tcave of the gap Gin the circumferential direction. Therefore, it is possible to get close to the state where the gap G during the operation is uniform over the circumferential direction.

In some embodiments, the gap G during the stop of the impeller W has the maximum value tcmax during the stop of the impeller W within an angular range of not less than −90 degrees and not more than 0 degrees.

In the case in which the casing C includes the scroll part 7, 8, the flow-passage cross-sectional area of the scroll flow passage 7*a*, 8*a* is the largest within the above-described angular range of not less than −90 degrees and not more than 0 degrees, in general.

Moreover, as described above, at the position, where the flow-passage cross-sectional area is the largest, of the position along the extending direction of the scroll flow passage 7a, 8*a*, the decrement of the gap G during the operation relative to the gap G during the stop is the largest.

In this regard, in some embodiments, as shown in FIG. 10, the gap G during the stop of the impeller W has the maximum value tcmax during the stop of the impeller W within the angular range of not less than −90 degrees and not more than 0 degrees. Therefore, it is possible to get close to the state where the gap G during the operation is uniform over the circumferential direction.

In some embodiments described above, it is preferable that the size of the gap G during the stop of the impeller W is formed non-uniformly over the circumferential direction of the impeller W, in at least one of the following (a) or (b).

(a) at least a part of a region between the leading edge 36, 46 and a position away by a distance of 20% of the total length of the tip 34, 44 from the leading edge 36, 46 toward the trailing edge 37, 47 of the blade B (b) at least a part of a region between the trailing edge 37, 47 and a position away by a distance of 20% of the total length from the trailing edge 37, 47 toward the leading edge 36, 46

In the turbomachinery 10, it is possible to effectively improve efficiency of the turbomachinery 10 by narrowing the gap Gin the vicinity of the leading edge 36, 46 and in the vicinity of the trailing edge 37, 47.

In this regard, in at least one of the above (a) or (b), if the gap G is formed non-uniformly over the circumferential direction, in at least one of the vicinity of the leading edge 36, 46 or the vicinity of the trailing edge 37, 47, it is possible to get close to the state where the gap G during the operation is uniform over the circumferential direction. Thus, it is possible to effectively suppress the efficiency decrease in the turbomachinery 10.

If the gap G is formed non-uniformly over the circumferential direction of the impeller W in only one of the above (a) or (b), it is preferable that the gap G is formed non-uniformly over the circumferential direction of the impeller W in the above (a), that is, not the outlet side but the inlet side of the fluid.

In the above description, the radial flow turbomachinery 10 has mainly been described. However, the above-described configuration is also applicable to the axial flow turbomachinery 10A as shown in FIG. 11, and has the same technical effects.

In the turbomachinery 10A including the axial flow impeller W, there is a case in which the size of the casing C along the axial direction is relatively large, such as a case in which a plurality of stages of blades are disposed along the axial direction or a case in which the turbomachinery is relatively large. In this case, the casing C may be supported by the first support table 111 and the second support table 112 disposed away from the first support table 111 in the direction along the rotational axis AXw of the impeller W.

In this case, as shown in FIG. 12, in the turbomachinery 10B, the casing C easily bends downward between the first support table 111 and the second support table 112, under its own weight. Thus, during the operation of the conventional turbomachinery 10B, it is considered that the casing C bends more easily due to the influence of thermal expansion or the like.

In FIG. 12, the casing C represented by the dashed line is the casing C before bending as described above. In FIG. 12, the deformation of the casing C is overdrawn.

Thus, in consideration of an influence on the gap G given by the above-described bend of the casing C, the gap G during the stop of the impeller W is formed non-uniformly over the circumferential direction of the impeller W, making it possible to get close to the state where the gap G during the operation is uniform over the circumferential direction. Thus, it is possible to suppress the efficiency decrease in the turbomachinery 10A including the axial flow impeller W.

More specifically, for example, as shown in FIG. 13, 14, a size tcl of the gap G during the stop of the impeller W is larger than the average value tcave of the size of the gap Gin the circumferential direction, at an intermediate position P1 between the first support table 111 and the second support table 112, and at a position P2, of a position along the circumferential direction, in a vertically upward direction of the impeller W.

The average value tcave is an average value at the intermediate position P1.

In the conventional turbomachinery 10B where the casing C is supported by the first support table 111 and the second support table 112, the casing easily bends downward between the first support table 111 and the second support table 112, and it is considered that the casing bends more easily during the operation of the turbomachinery 10B, as described above.

In this regard, since the size tcl of the gap G is larger than the average value tcave of the size of the gap G in the circumferential direction at the intermediate position P1 and at the position P2 in the vertically upward direction described above, it is possible to get close to the state where the gap G during the operation at the intermediate position P1 is uniform over the circumferential direction.

Moreover, for example, as shown in FIG. 13, 15, a size tc2 of the gap G during the stop of the impeller W is larger than the average value tcave of the size of the gap G in the circumferential direction, at positions P3 at both ends of the impeller W along the direction of the rotational axis AXw, and at a position P4, of the position along the circumferential direction, in a vertically downward direction of the impeller W.

The average value tcave is an average value at the position P3.

In the conventional turbomachinery 10B where the casing C is supported by the first support table 111 and the second support table 112, at the positions P3 at both ends of the impeller W along the direction of the rotational axis AXw, the casing C easily bends upward, contrary to the case of the intermediate position P1 between the first support table 111 and the second support table 112, and it is considered that the casing C bends more easily during the operation of the turbomachinery 10B.

In this regard, since the size tc2 of the gap G during the stop of the impeller W is larger than the average value tcave of the size of the gap G in the circumferential direction at the positions P3 at both ends of the impeller W along the direction of the rotational axis AXw and at the position P4, of the position along the circumferential direction, in the vertically downward direction of the impeller W, it is possible to get close to the state where the gap G during the operation at the positions P3 at both ends of the impeller W along the direction of the rotational axis is uniform over the circumferential direction.

The present invention is not limited to the above-described embodiments, and also includes an embodiment obtained by modifying the above-described embodiments and an embodiment obtained by combining these embodiments as appropriate.

REFERENCE SIGNS LIST

1 Turbocharger
2 Rotor shaft
3 Turbine wheel
4 Compressor wheel
5 Casing (turbine housing)
6 Casing (compressor housing)
7, 8 Scroll part
7*a*, 8*a* Scroll flow passage
10 Turbomachinery
10A Axial flow turbomachinery
10B Conventional axial flow turbomachinery
30 Turbine
34, 44 Tip
40 Compressor
41 Tongue part
51 Inner surface
51*a* Inner circumferential edge
AXc Center axis
AXw Rotational axis
B Blade
C Casing
G Gap
W Impeller

The invention claimed is:

1. A turbomachinery comprising:
an impeller including at least one blade; and
a casing for housing the impeller rotatably,
wherein a size of a gap between a tip of the blade and an inner surface of the casing during a non-operational state of the impeller during which the impeller is not rotating is formed non-uniformly over a circumferential direction of the impeller, and
wherein, during the non-operational state of the impeller, a center axis of the casing is not parallel to a rotational axis of the impeller.

2. The turbomachinery according to claim 1, wherein a difference between a maximum value and a minimum value of the gap in a circumferential direction of the impeller during the non-operational state of the impeller is not less than 10% of an average value of the gap in the circumferential direction.

3. The turbomachinery according to claim 1, wherein the casing has an inner circumferential edge formed into an elliptical shape.

4. The turbomachinery according to claim 1,
wherein the impeller is a radial flow impeller, and
wherein the casing is rotationally asymmetric about a center axis of the casing.

5. The turbomachinery according to claim 4, wherein the casing includes:
a scroll part internally including a scroll flow passage where a fluid flows in the circumferential direction on a radially outer side of the impeller; and
a tongue part for separating the scroll flow passage from a flow passage on a radially outer side of the scroll flow passage, and
wherein, regarding the gap during the non-operational state of the impeller, the gap in the tongue part is larger than an average value of the gap in the circumferential direction.

6. The turbomachinery according to claim 5,
wherein, provided that an angular position of the tongue part is at 0 degrees in an angular range in the circumferential direction, and a direction, of an extending direction of the scroll flow passage, in which a flow-passage cross-sectional area of the scroll flow passage in a cross-section orthogonal to the extending direction gradually increases with distance from the tongue part along the extending direction, is a positive direction,
the gap during the non-operational state of the impeller has a maximum value during the non-operational state stop of the impeller within an angular range of not less than −90 degrees and not more than 0 degrees.

7. The turbomachinery according to claim 1, wherein the size of the gap during the non-operational state of the impeller is formed non-uniformly over the circumferential direction of the impeller, in at least one of at least a part of a region between a leading edge of the blade and a position away by a distance of 20% of a total length of the tip from the leading edge toward a trailing edge of the blade, or at least a part of a region between the trailing edge and a position away by a distance of 20% of the total length from the trailing edge toward the leading edge.

8. The turbomachinery according to claim 1,
wherein the impeller is an axial flow impeller with a rotational axis thereof extending in a horizontal direction, and
wherein the casing is supported by a first support table and a second support table disposed away from the first support table in a direction along the rotational axis of the impeller.

9. The turbomachinery according to claim 8, wherein the gap during the non-operational state of the impeller is larger than an average value of the gap in the circumferential direction, at an intermediate position between the first support table and the second support table and at a position, of a position along the circumferential direction, in a vertically upward direction of the impeller.

10. The turbomachinery according to claim 8, wherein the gap during the non-operational state of the impeller is larger than an average value of the gap in the circumferential direction, at positions at both ends of the impeller along a direction of the rotational axis, and at a position, of a position along the circumferential direction, in a vertically downward direction of the impeller.

11. The turbomachinery according to claim 1, wherein a variation in the size of the gap in the circumferential direction is larger during the non-operational state of the impeller than during a rotation of the impeller.

* * * * *